United States Patent [19]

Wellenhofer et al.

[11] 4,221,755

[45] Sep. 9, 1980

[54] PROCESS FOR THE MANUFACTURE OF SYNTHETIC FILAMENTS HAVING A CIRCULAR CROSS-SECTION

[75] Inventors: Herbert Wellenhofer; Hans-Otmar Stahl, both of Bobingen, Fed. Rep. of Germany

[73] Assignee: Hoechst Aktiengesellschaft, Fed. Rep. of Germany

[21] Appl. No.: 923,556

[22] Filed: Jul. 11, 1978

[30] Foreign Application Priority Data

Jul. 16, 1977 [DE] Fed. Rep. of Germany ..... 2732265

[51] Int. Cl.[2] ..... D01D 1/10

[52] U.S. Cl. ..... 264/169; 264/176 F; 264/177 F; 425/72 S; 425/464

[58] Field of Search ..... 264/177 F, 169, 176 F; 425/464, 382, 72 S

[56] References Cited

U.S. PATENT DOCUMENTS

| | | | |
|---|---|---|---|
| 2,294,894 | 9/1942 | Draemann | 264/177 F |
| 2,447,994 | 8/1948 | Wicker | 264/177 F |
| 3,255,487 | 6/1966 | Nieuwenhuysen | 425/467 |
| 3,418,200 | 12/1968 | Tanner | 264/177 F |
| 3,475,147 | 10/1969 | Stalego | 264/177 F |
| 3,605,162 | 9/1971 | Long | 264/177 F |
| 3,608,040 | 9/1971 | Green | 264/176 F |
| 3,691,749 | 9/1972 | McKay | 264/177 F |
| 3,804,569 | 4/1974 | Walker | 425/225 |
| 3,975,475 | 8/1976 | Foley | 264/28 |

FOREIGN PATENT DOCUMENTS

| | | | |
|---|---|---|---|
| 722547 | 11/1965 | Canada | 264/177 F |
| 1227606 | 10/1966 | Fed. Rep. of Germany . | |
| 1975310 | 10/1967 | Fed. Rep. of Germany . | |
| 1710621 | 1/1977 | Fed. Rep. of Germany . | |
| 2351668 | 4/1977 | Fed. Rep. of Germany . | |
| 42-22574 | 11/1967 | Japan | 264/177 F |

*Primary Examiner*—Jay H. Woo

*Attorney, Agent, or Firm*—Connolly and Hutz

[57] ABSTRACT

Synthetic filaments having a circular cross-section are manufactured by melt-spinning from spinneret openings having likewise a circular cross-section which are provided with lateral arms distributed over their circumference and ending in the circular cross-section area at an about right angle. The lateral arms need not cover the complete length of the spinneret holes, but only the outlet opening of the spinneret holes.

4 Claims, 3 Drawing Figures

PROCESS FOR THE MANUFACTURE OF SYNTHETIC FILAMENTS HAVING A CIRCULAR CROSS-SECTION

The present invention provides a process for the manufacture of synthetic filaments having a circular cross-section by melt-spinning from spinneret openings having a circular cross-section.

When melt-spinning synthetic filaments having a circular cross-section, it has been observed that there are certain filaments which do not follow the draw-off direction in a straight line, but form a curve immediately below the surface of the spinneret. This phenomenon has been often described as the so-called "knee formation", and it results in a uneven titer especially in the case where this curvature occurs at varying times.

The patents literature, for example German utility model No. 19 75 310, proposes to cover the surface of the spinneret with a protecting gas in order to prevent this knee formation. This proposal is based on the assumption that knee formation is caused by disturbances due to deposits of degraded polymer on the surface of the spinneret.

Attempts have furthermore been made to prevent knee formation by a special shaping of the outlet orifice of the spinneret, especially by sharp edges, as this is described in German Auslegeschrift No. 12 27 606 and German Auslegeschrift No. 17 10 621.

Silicon coating of the spinneret surface is furthermore described, for example in German Auslegeschrift No. 23 51 668.

The only expedient for these proposed means obviously as expensive as unsatisfactory remains therefore cleaning of the spinnerets which can be facilitated by special devices, as they are described for example in U.S. Pat. Nos. 3,804,569 and 3,975,475.

Surprisingly, it has now been found that these expensive measures hitherto taken in order to spin synthetic yarns having a circular cross-section according to the melt-spinning process from spinneret openings having a circular cross-section too, can be omitted when, in accordance with this invention, these spinneret openings having the diameter D are provided with lateral arms distributed over their circumference which end in the area of the circle at an about right angle.

Advantagously, from 1 to 5, preferably 3, lateral arms are cut into the opening. In the case of more than one lateral arms, they are preferably of identical shape and distributed symmetrically over the circumference of the circular spinneret opening.

Figure 1:
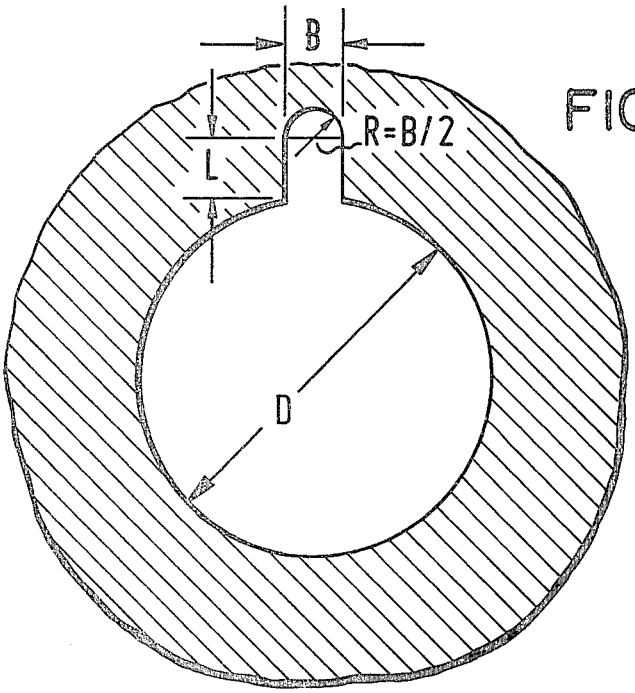

The radial extention of the lateral arms is preferably 1/10 D to $\frac{1}{3}$ D, and the width B is preferably from 1/15 D to $\frac{1}{3}$ D, wherein D stands for diameter of the circular spinneret opening (see FIG. 1).

For manufacturing reasons, the ends of the lateral arms are shaped as a semi-circle the diameter of which corresponds to the width B.

By lateral arms, there are to be understood in this case extensions of the circular cross-section of the spinneret opening, which extensions end in the circumference at an about right angle, and the width B of which remains constant or even decreases in radial direction outward.

These lateral arms must be distinguished from the so-called sub-holes according to German Offenlegungsschrift No. 22 40 742, the width of which has a minimum value at the place where they end in the circumference and increases in outward direction. These spinneret holes are intended for the manufacture of profiled filaments, especially of asymmetric profiles, in order to obtain a spontaneous tendency to crimping.

In contrast thereto, the process of the inventin allows the obtention of filaments having a circular cross-section and a high degree of titer uniformity without encountering troubles during the spinning operation by means of circular spinneret openings having lateral arms. In the feeder channel leading to the spinneret orifice, these lateral arms seem to incite turbulences which prevent deposition of degraded polymer. It is therefore an essential of the present invention that these lateral arms end in the circumference at an about right angle.

Surprisingly, it has been observed that the spinneret hole needs not be provided with lateral arms over its complete length, but that it is sufficient to provide only the direct surroundings of the outlet opening with lateral arms.

With increasing number of lateral arms, the deviation of the filament cross-section from the circular shape decreases; however, the risk of knee formation increases simultaneously.

Tests proved that 1 to 5 lateral arms are well suitable; three lateral arms uniformly distributed over the circumference gave best results with respect to running behavior and roundness of the filaments.

Also with respect to area extension and shape of the lateral arms, the maximum values resulted in an improved stabilization of the filament motion, but on the other hand a visible profile formation, too. The minimum values are determined, apart from the running behavior, by the required easy cleaning of the spinneret plate.

Test series proved that filaments can be defined as being circular when the deviation of their cross-section from circularity is below 8%; the process of the invention allowing to obtain a deviation below 5% with a simultaneous good running behavior in the spinning operation. The Examples show filaments the deviation of which is 3 to 4%.

The deviation of the filament cross-section from circularity amounts to a hundredfold of the quotients of the difference between circumferential and inside diameter and the filament inside diameter; this deviation, for example, is 100% in the case of an equilateral triangle, and 41% in the case of a square.

Figure 2:
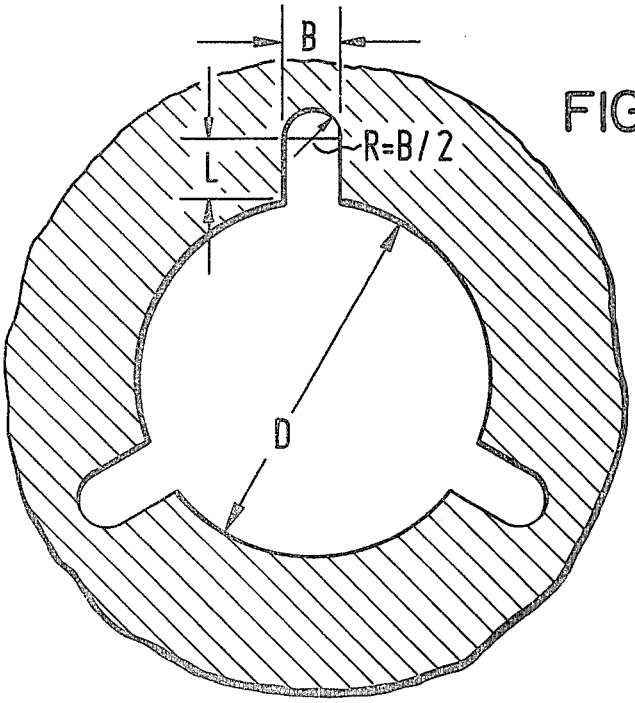
Figure 3:
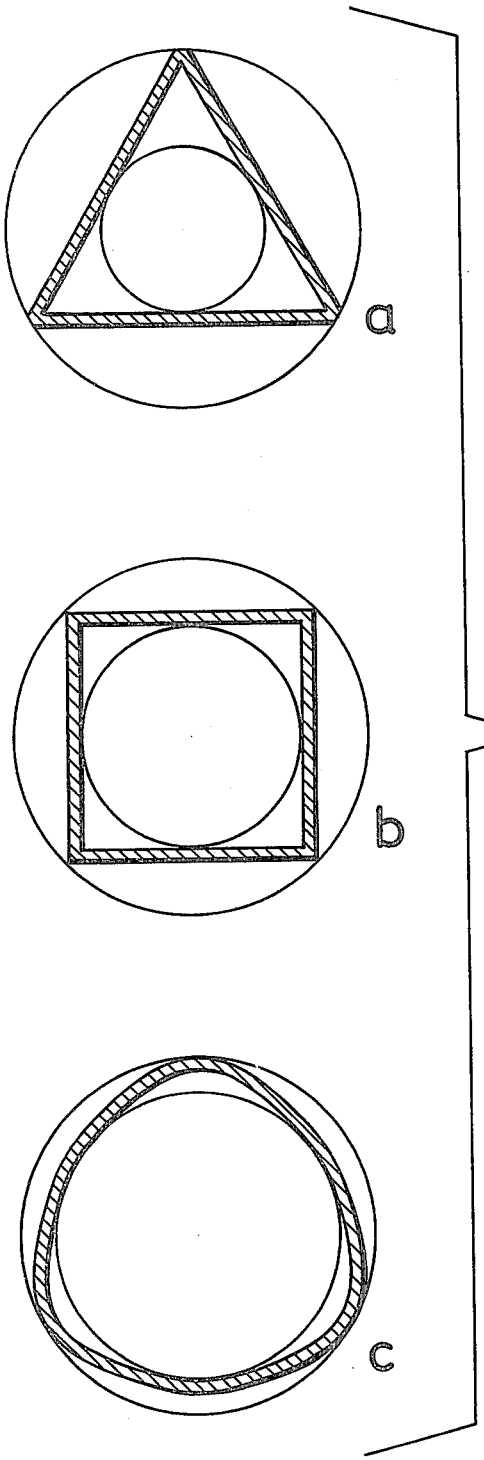

The process of the invention will be better understood by reference to the accompanying drawings, in which FIG. 1 is a cross-sectional view of a spinneret opening according to the invention which contains 1 lateral arm as described in Example 1;

FIG. 2 shows a spinneret opening having 3 lateral arms according to Example 2; and FIG. 3 represents examples for determining the deviation of the filament cross-section from circularity: FIGS. 3*a* and 3*b* show an equilateral triangle and a square, respectively, and FIG. 3*c* is a schematic cross-sectional view of filament obtained according to the process of the invention; the deviation being heavily magnified in this drawing.

The process of the invention is suitable for all filament-forming, melt-spinnable synthetic polymers such as polyamides, polyesters or polyolefins, as well as mixtures of these polymers and modified polymers.

The following Examples demonstrate the advantages of the process of the invention when spinning monofilaments having diameters of 34 and 48 microns, respectively. Although the process of the invention is suitable for all titer ranges, its advantages become manifest especially in the case of coarse titers.

Examples 1 to 3 were carried out using polyethylene terephthalate having a specific viscosity of 0.76, measured at 25° C. on a 1% by weight solution of the polymer in a mixture of 60 parts by weight of phenol and 40 parts by weight of tetrachloro-ethane; the polyethylene terephthalate contained 0.4% by weight of $TiO_2$. The spinning temperature was 290° C.

EXAMPLE 1

Spinneret opening having 1 lateral arm the length and width of which being 1/6 D. Diameter D of opening: 0.30 mm.

Within a sufficiently long observation time (in order to avoid the risk of an erroneous average value due to occuring variations), usual round hole spinneret yield 4.3% of moving knees in the melt strand below the spinneret opening, while the spinneret of Example 1 produce only 1.6% of moving knees within the same period of time. The deviation of the filament cross-section from circularity is 8% and clearly visible.

EXAMPLE 2

Spinneret opening having 3 lateral arms spaced at angles of 120°, the length and width of which being 1/6 D.

Within the observation period of Example 1, usual round hole spinnerets yield 4.0% of moving knees in the melt strand below the spinneret, while the nozzles of Examples 2 produce only 0.7% of such moving knees within the same period of time. This considerable improvement as compared to the spinneret of Example 1 is surprising inasmuch as the deviation of the filament cross-section from circularity, at 6%, is clearly less than in Example 1. Furthermore, this deviation from circularity is less visible because of the symmetric arrangement of the 3 lateral arms.

Surprisingly, it has been observed that the deviation from circularity decreases with increasing diameter of the filaments. Thus, 2.8% deviation from circularity were stated in the case of drawn filaments having a diameter of 0.048 mm, and 4.3% deviation for a drawn filament having a diameter of 0.034 mm.

EXAMPLE 3

Comparably good results as those of Example 2 were obtained in the case of a spinneret plate having a thickness of 15 mm and containing holes of an initial 2.5 mm diameter which ended in a diameter of 0.4 mm over a length of 1.6 mm, and only 0.4 mm of this length just before the outlet face of the spinneret was provided with 3 lateral arms having a length and width of 0.05 mm, respectively.

What is claimed is:

1. A process for the manufacture of synthetic filaments having a circular cross-section by melt-spinning from spinneret openings having a circular cross-section, wherein these spinneret openings having the diameter D are provided with lateral arms distributed over their circumference which end in the area of the circle at an about right angle.

2. The process as claimed in claim 1, wherein the spinneret openings are provided with 1 to 5, preferably 3, lateral arms.

3. The process as claimed in claim 1, wherein the lateral arms are of identical shape and distributed symmetrically over the circumference.

4. The process as claimed in any one of claims 1 to 3, wherein the lateral arms do not cover the complete length of the spinneret holes, but only the outlet openings of the spinneret holes.

* * * * *